United States Patent [19]

Steury

[11] 4,332,465

[45] Jun. 1, 1982

[54] BALANCED PHOTOCONDUCTOR USAGE CONTROL SYSTEM

[75] Inventor: Thomas D. Steury, Longmont, Colo.

[73] Assignee: International Business Machines Corporation, Armonk, N.Y.

[21] Appl. No.: 189,874

[22] Filed: Sep. 23, 1980

[51] Int. Cl.[3] ..... G03G 15/00

[52] U.S. Cl. ..... 355/14 R; 355/3 BE; 355/3 DR; 355/14 E; 355/25

[58] Field of Search ..... 355/3 R, 3 BE, 3 DR, 355/7, 14 R, 14 D, 14 E, 15, 25, 16, 40

[56] References Cited

U.S. PATENT DOCUMENTS

| | | | |
|---|---|---|---|
| Re. 29,179 | 4/1977 | Davidge et al. | 355/14 |
| 3,785,730 | 1/1974 | Weber et al. | 355/16 |
| 4,139,300 | 2/1979 | Katayama et al. | 355/14 |
| 4,140,386 | 2/1979 | Satomi | 355/14 R |
| 4,175,851 | 11/1979 | Kitamura et al. | 355/14 R |
| 4,200,390 | 4/1980 | Tagashira et al. | 355/14 R |
| 4,218,130 | 8/1980 | Satomi et al. | 355/14 R |

*Primary Examiner*—Arthur C. Prescott

*Attorney, Agent, or Firm*—J. H. Holcombe; J. Jancin, Jr.; Y. S. Yee

[57] ABSTRACT

A balanced photoconductor usage control system for an electrophotographic copier/printer machine having a photoconductor containing thereon two page images areas, is employed to solve the problem of excessively high background level due to toner filming. More specifically, the control system includes memory means for retaining a location of a last page image area which was last used to produce a page, and control means jointly responsive to a presence of a full page condition in a page buffer, and to the memory means to effect production of a next page on an alternate page image area.

16 Claims, 4 Drawing Figures

BALANCED PHOTOCONDUCTOR USAGE CONTROL SYSTEM

DESCRIPTION

TECHNICAL FIELD

This invention relates generally to an electrophotographic machine of the type having both a copy mode and a print mode, and more particularly to a balanced photoconductor usage control system for such an electrophotographic machine featuring an endless run of photoconductor containing thereon multiple page image areas.

BACKGROUND ART

Conventional techniques and apparatus employed in an electrophotographic machine for both making copies from an original document, and printing using data stored in a buffer, are known. Electrophotographic machines incorporating these techniques and features can have both a copy mode and a print mode.

In a typical copier/printer machine, an endless run of photoconductor medium having multiple page image areas carried by an electrophotographic drum is first subjected to an electrostatic station for uniform charging. An endless run of photoconductor in this context is defined to include a continually rotated photoconductor. The photoconductor may be subjected to occasional indexing around the drum from a supply roll to a take-up roll, both of which are internal to the drum. In the copy mode, a page image area on the photoconductor is then selectively imaged by light reflected from an original document. In the print mode, the photoconductor page area is imaged instead by a laser beam which is controlled by a text-defining binary data, for example, as described in U.S. Pat. No. 3,898,627. A character generator, as described in the reference patent, is enabled to drive the laser beam only after a page buffer is filled with a full page.

In either modes, the resulting electrostatic latent image is then toned by a developer by applying a toner to the latent image. The developed image is then removed from the photoconductor image area to a copy sheet for subsequent fixing, as the drum rotates in a given direction at a constant speed.

While the above described electrophotographic process operates synchronously with the rotation of the drum, the time it takes to assemble the text and to fill the page buffer to its full-page condition, as in the print mode, is page data content dependent. A full-page condition of the page buffer in this context is defined to include a page with a variable record length and a variable amount of blank space on the page. Hence, the readiness of the page buffer may be such that it does not permit synchronous operation with the associated electrophotographic process. Depending on the page data content, it is thus possible that one page image area can be used over and over while the remaining page image areas are unused for a number of consecutive print cycles. When this occurs, the unused page image area on the photoconductor medium experiences graduate "toner cloud" build-up. This toner cloud build-up is the result of an accumulation of excess or non-transferred charged toner particles between successive print cycles.

The phenomenon of toner cloud build-up, also known as "toner filming", tends to affect adversely the quality of the first prints which are made when any one of the unused page image areas is used to produce a page after a number of consecutive unused print cycles. More specifically, this undesirable effect shows up as excessively high background level on such first prints produced.

This toner filming problem is particularly noticeable if a page image area passes through unused for five or more consecutive print cycles. Such unbalanced page image area usage could happen while in the print mode because of the above described asynchronous operation of the page buffer with the associated electrophotographic process. The undesirable high background level is especially severe and unacceptable in electrophotographic machines using a particular type of toner composition, or in such machines wherein the electrophotographic process is designed to operate at a slow speed so as to optimize other print/copy qualities, such as optical density, offset master quality, and recycle rate, in order to obtain overall high quality prints and copies.

The above described print quality degradation on the first prints produced could be substantially alleviated by limiting toner filming build-up on the photoconductor medium by subjecting the page image areas thereon to brush cleaning during every print cycle, regardless of usage. Brush cleaning is accomplished usually by scrubbing the photoconductor medium with fibers. A cleaning operation of this type occurring in every print cycle minimizes toner cloud build-up and therefore alleviates the problem of high background level.

Brush cleaning in every print cycle, however, is not an acceptable solution to the above-described toner filming problem. The relatively high ambient temperature inside a typical electrophotographic machine causes the brush fibers, upon rubbing, to react with the photoconductor medium, whereby a thin layer of Teflon, also known as "clear filming" is deposited on the photoconductor medium. As a result, brush cleaning of the photoconductor medium in every print cycle produces a repeated accumulation of clear filming on the unused page image areas. This repeated accumulation causes an unacceptable "wash-out" effect, i.e., poor optical density on the first print produced when an unused page image area is employed to produce a print after not being used in several consecutive print cycles. Such a wash-out degradation is especially noticeable in half-tone printing.

Where the brush fibers are in physical contact with the photoconductor medium for a longer time period as is in the aforementioned electrophotographic process designed to operate at slow speed, the wash-out degradation in print quality is particularly severe and becomes even more intolerable.

The problem of toner filming has been encountered and noted in some earlier copier designs, however, none provides a solution to the problem in accordance to the invention described hereinafter.

Some prior electrophotographic copiers provide a scheme whereby forced alternate use of page image areas is achieved. As an example, U.S. Pat. No. Re. 29,179 to Davidge et al, discloses, in one embodiment, a reproduction apparatus having an electrophotographic plate containing thereon multiple imaging areas to effect alternate redevelopment and reimaging cycles when producing more than one copy of the same original document. This sequencing scheme results in situations where an image area can be skipped in order to facilitate maximum throughput.

Other prior electrophotographic copiers provide a scheme whereby an endless run of photoconductor medium is used uniformly for copying. An endless run of photoconductor in this context is defined to include a continually rotated photoconductor. The photoconductor may be subjected to occasional indexing around the drum from a supply roll to a take-up roll, both of which are internal to the drum. For instance, U.S. Pat. No. 4,139,300 to Katayama et al discloses a control system for a copier wherein clock pulses are generated per complete rotation of an endless photosensitive drum. The clock pulses are counted, and are utilized thereby to end each of the copier cycles by positioning the photoconductor medium at a rotational position different from its start position in that cycle so as to uniformly use the photoconductor, and elongate the life of the photoconductor medium.

Another prior electrophotographic copier providing means for more uniform photoconductor area usage is disclosed in U.S. Pat. No. 3,785,730 to Weber et al. The reference patent employs a control circuit having a marker and a marker detector. An elongated flexible electrophotographic belt is first marked in a run, and the mark is then detected during a following run. The position of the belt relative to a reproduction commencement position is varied in accordance with the mark such that the image-forming surfaces for the following run are positioned in areas between image-forming surfaces for the proceeding run to insure that different areas of the belt are used.

DISCLOSURE OF INVENTION

It is a principal object of the present invention to provide a balanced photoconductor usage control system to solve the problem of toner filming in an electrophotographic copier/printer machine having an endless run of photoconductor containing thereon multiple page image areas.

It is also an object of this invention to provide a solution, which is free of other side-effect problems such as the problem of clear filming, to the above-described problem of toner filming in electrophotographic printer/copier machines.

This and other objects of the present invention can be achieved by way of a balanced photoconductor usage control system having memory means for retaining a location of a last page image area which was last used to produce a page, and control means jointly responsive to the presence of a full page of data within a page buffer, and the memory means to effect production of an immediate next page on other than the last used page image area.

The nature, principle and utility of the present invention will be better understood from the hereinafter detailed description of the invention, when read in conjunction with the accompanying drawings.

BRIEF DESCRIPTION OF DRAWINGS

The details of the invention will be described in connection with the accompanying drawings, in which.

BEST MODE FOR CARRYING OUT THE INVENTION

Figure 4:
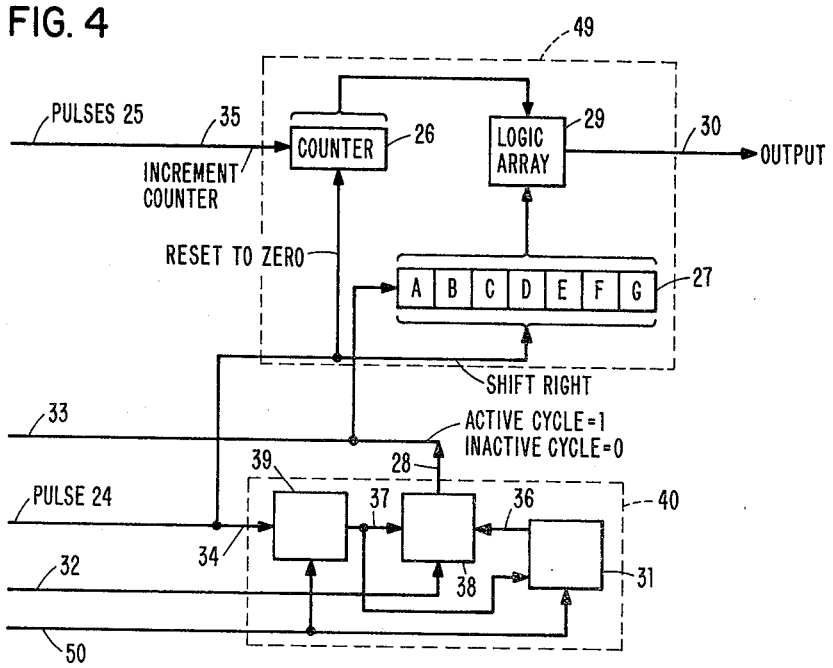
FIG. 4 shows the balanced photoconductor usage control system and other associated circuits according to the invention.

As illustrated in FIG. 4, a preferred embodiment of the balanced photoconductor usage control system 40 according to the present invention includes a last-usage latch 31, flip flop 39 and a control 38. The operation of control 38 is conditioned upon inputs from flip flop 39, full-page condition signed on conductor 32 and the last-usage latch 31.

The balanced photoconductor usage control system 40 operates cooperatively in conjunction with waveform generator 49 to control the various operations of an electrophotographic machine having both a copy mode and a print mode. Such copier/printer machines are known to one skilled in the art, and one is described in detail in U.S. Pat. No. 4,046,471 to Branham et al.

COPIER/PRINTER OPERATION

Figure 1:
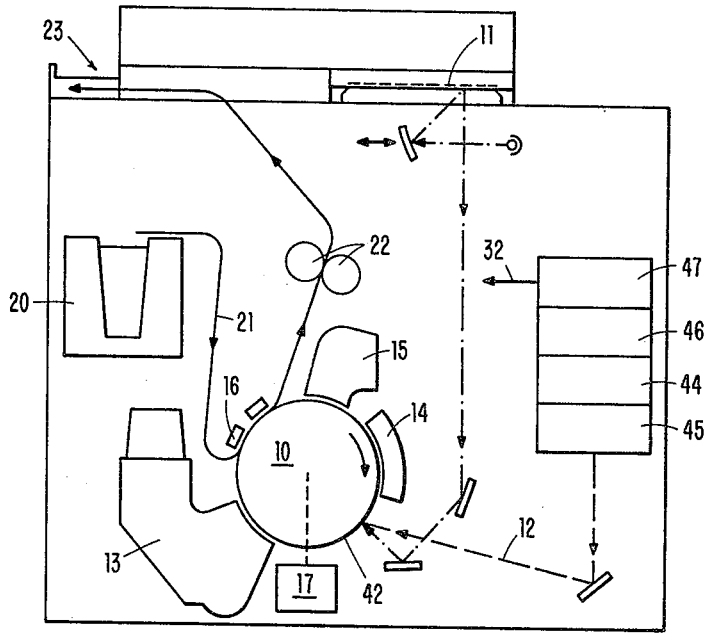
FIG. 1 is a diagram of an electrophotographic copier/printer machine having both a copy mode and a print mode.

In a copier/printer machine shown in FIG. 1, a photoconductor medium 42 having two page image areas 18 and 19 (FIG. 2) is carried by an electrophotographic drum 10. In order to produce a print or a copy, an electrostatic latent image of the page must be produced. This is accomplished by having page image area 18 or 19 first subjected to uniform electrostatic charging at corona station 14. In a copy mode, the page image area 18 or 19 on the photoconductor medium 42 is then selectively imaged by light reflected from an original document 11. In a print mode, the page area 18 or 19 is imaged instead by a modulated laser beam 12 from a laser print head 45, which is controlled by a text-defining binary data, as described in U.S. Pat. No. 3,898,627 to Hooker et al.

More specifically, as described in the above reference patent, the text defining binary data is first assembled and stored in a page buffer 46. Each character or symbol to be printed, as well as the spaces to be inserted between characters, are stored in the page buffer 46 at individual memory addresses which are, in turn, associated with the writing lines of the page and with the other position of the character within the writing line. Data input for filling the page buffer 46 may come from either magnetic card or a communication line input (both not shown) under the control of data processor 47 which also assembles the binary text before filling the page buffer 46. At the end of assembling and filling a page, which can be of variable length, ending with an end of page marker signal, data processor 47 produces a "1" on conductor 32 to signify that page buffer 46 is full and ready. After this full page condition in the page buffer 46 occurs, character generator 44 operates under the command of control 38 (to be described hereinafter) to provide the necessary binary dot pattern to control the modulated laser beam 12.

Character generator 44 is a full-page, raster scan, proportional space type. Printing using character generator 44 is accomplished by sequentially generating parts of different characters in a single scan. The details and operation of the character generator are fully described in U.S. Pat. No. 4,000,486 to Schomburg. In addition, the details and operation of the laser print head 45 which produces the modulated laser beam 12 for imaging area 18 or 19 are more particularly described in U.S. Pat. Nos. 3,750,189; 4,046,471 and 4,144,539.

In either the print mode or copy mode machine operation, the resulting electrostatic latent image on area 18 or 19 is then toned by a developer 13 by applying a toner to the electrostatic laser beam image. The developed image is then removed from the photoconductor image area to a copy sheet at transfer station 16 for subsequent fixing. In addition, the page image areas 18 and 19 may be subjected to cleaning at station 15, as the drum 10 rotates in the clockwise direction at a constant speed. The electrophotographic process itself is thus cyclical in nature and operates synchronously with respect to the rotation of drum 10.

Figure 2:
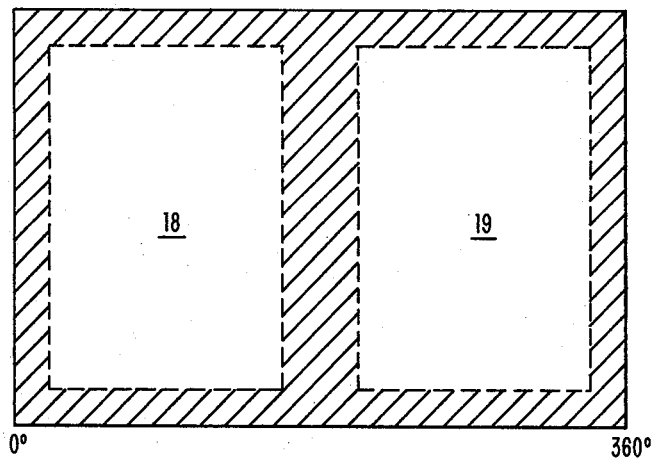
FIG. 2 shows the photoconductor drum "unrolled" to show two page image areas.

FIG. 2 shows drum 10 "unrolled" to show two page image areas 18 and 19 corresponding to the area in contact to a sheet of paper at transfer station 16 (FIG. 1). Sheets of paper are supplied, one sheet at a time, from bin 20. These sheets of paper follow path 21 including passing through hot fuser rolls 22 to reach exit pocket 23.

Details of an electrophotographic copier/printer are well known to those skilled in the art and form no part of this invention. It is to be understood that a variety of techniques exists for laser printing and for performing the various individual functions of the electrophotographic process identified.

The instantaneous position of drum 10 may be indicated by position transducer 17 (FIG. 1). Such transducer 17 may be of the type including two stationary Hall-effect detectors and a rotating magnetic wheel having thereon periodic pole pieces, and riding in common on the shaft of drum 10. The Hall-effect detectors produce two drum position pulses 24 and 25. Other suitable conventional transducers may also be used.

Figure 3:
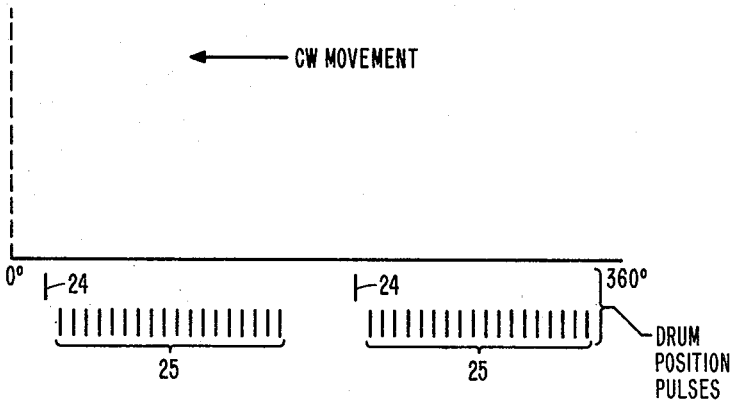
FIG. 3 shows the transducer output pulses during one revolution of the photoconductor drum.

The output pulses of position transducer 17 are shown in FIG. 3. Two groups of drum position pulses, one corresponding to each of the page image areas 18 and 19 (FIG. 2), are produced by the two stationary Hall-effect detectors. More specifically, each of the two page image areas 18 and 19 is identified by a main synchronization pulse 24 and then follows with a number of minor pulses 25, for example, 16 in number.

BALANCED PHOTOCONDUCTOR USAGE CONTROL SYSTEM

When the copier/printer machine is first powered on, system reset line 50 resets both flip flop 39 to its "0" state, and the last-usage latch 31 to its "0" state. An arrangement of flip flop 39 and last-usage latch 31, in essence, defines a consistent page image area identification scheme. More specifically, a "0" state of flip flop 39 signifies that page image area 18 is immediately available, likewise a "1" represents the same for area 19; a "1" state for the last-usage 31 signifies that page image area 19 was last used, likewise, a "0" represents that image area 18 was last used. The assigned "0" and "1" states of last-usage latch 31 and of flip flop 39 as they correspond to image areas 18 and 19 are arbitrary. They become specifically defined at the first usage of an image area after power on, when the content of flip flop 39 is transferred to the last-usage latch 31 through conductor 37. This is to say that whichever image area is used first after power on will be designated as page image area 19, and the other one as 18. As will be described hereinafter, the states of flip flop 39 and last-usage latch 31 are compared, just prior to the beginning of a print cycle, by control 38 for a proper print operation. The state of flip flop 39 is reversed by each sync pulse 24 at the beginning of each active or inactive cycle, and the content of last-usage latch 31 is updated by way of conductor 37 by that of flip flop 39 at beginning of every active print cycle.

Waveform generator 49 comprises logic array 29, counter 26, and shift register 27. Generator 49 works in cooperation with balanced photoconductor usage control 40 to produce a plurality of control output signals on cable 30. Such control signals are used to control the operations of various electrophotographic apparatus. More specifically, counter 26 is first reset by sync pulse 24 on conductor 34 and is then incremented by minor pulses 25 on conductor 35, and a shift register 27 the content of which is shifted right by one position for each synchronization pulse 24 on conductor 34. In an active cycle, a signal input 28 is arranged to insert a binary "1" into the first stage A of shift register 27. This is accomplished by a shift right operation utilizing synchronization pulse 24 if that particular photoconductor page image area 18 or 19, which generates the synchronization pulse 24, is to be used to make a page, either by use of the original document 11 or laser beam 12. If no such page is to be made, as in an inactive cycle, a binary "0" is inserted into the first shift register stage A by the shift right operation utilizing synchronization pulse 24.

Logic array 29 compares the state of the shift register stages A–G to the advancing stage of counter 26, to provide a plurality of output signals on cable 30. While only shift register stages A–C are necessary to control the electrophotographic drum process, additional stages D–G are used to monitor items, such as paper movement downstream of transfer station 16. The output signals on cable 30 are therefore used to control the various electrophotographic apparatus which require controls synchronous with the electrophotographic drum position.

These parts of the preferred embodiment form no part of the present invention, and are only included to illustrate the environment in which the invention may be embodied and to facilitate an understanding of the invention.

While the above-described electrophotographic process operates in a cyclical manner, and in synchronization with the rotation of drum 10, the time it takes to assemble the text and to fill the page buffer 46 to its full-page condition, as in the print mode, is page data content dependent. More specifically, the optical printing device of U.S. Pat. No. 3,898,627 includes a page buffer 46 (FIG. 1) into which a complete page of binary data must be assembled before an active signal "1" is issued to print control line 28 (FIG. 4). A full page condition of the page buffer 46 in this context is defined to include a page with a variable record length and a variable amount of blank space on the page. Thus, depending on the page data content, the readiness of the page buffer 46 may be such that it does not permit the character generator 44 and the laser printing operation to be performed in a synchronous manner with the associated electrophotographic process.

When the device of FIG. 1 is operating in the print mode, last-page latch 31 provides a memory of the last one of page image area 18 or 19 which was used to make a page. The next occurrence of the signal on conductor 32 indicating that the page buffer 46 now contains a page to be laser printed, does not result in activation of conductor 28 until photoconductor drum 10 is in a position to use the other one of the photoconductor page image areas 18 or 19. This function is achieved by control 38 working in conjunction with the last-usage latch 31 via conductor 36, the page buffer ready signal at conductor 32, and the output of flip flop 39.

The present invention as embodied in the drawing in FIG. 4 can best be explained and understood by way of a specific illustration; consider a case in which the last page used was page image area 19. This usage information regarding page image area 19 is retained in last-usage latch 31. Referring to FIG. 4, whether the page image area 18 or 19 is available immediately is determined, as described earlier, by flip flop 39 from drum position synchronization pulses 24 emitted by position transducer 17. The conductor 32 is normally at a "0" state; the occurrence of a "1" on conductor 32 indicates that the page buffer 46 now contains a full page to be laser printed.

If the page image area immediately available were page image area 19 (i.e., a "1" state in flip flop 39), indicating that page image area 18 would be unused for the second consecutive time if page image area 19 is utilized, control 38 would produce a "0" on conductor 28. Sync pulse 24 associated with page image area 19 would place the "0" in the first stage A of shift register 27 by a shift right operation. Minor pulses 25 associated with page image 19, would increment counter 26. Logic array 29 would compare the state of the shift register to the advancing stages of counter 26 to provide a plurality of output control signals on cable 30. In this instance, the output signals at cable 30 provide the necessary control for an inactive electrophotographic process cycle, no new paper feeding, and appropriate controls for movement of papers downstream. Stated in another way, if the immediately available page image area is the last used page image area, as retained by last-usage latch 31, control 38 would place a "0" in stage A of shift register 27. As a result, an inactive cycle resulting in a skipping of page image area 19, and no change in the content of last-usage latch 31 is produced.

If the page image area immediately available were page image area 18 (i.e., a "0" state in flip flop 39), indicating that this is the proper page image area to be used, control 38 would produce a "1" on conductor 28. Sync pulse 24 associated with page image area 18 would place the "1" in the first stage A of shift register 27 by a shift right operation. Minor pulse 25 associated with page image area 18 would increment counter 26. Logic array 29 would then compare the state of the shift register 27 to the advancing stages of counter 26 to provide a plurality of output control signals on cable 30. In this instance, the plurality of output signals include pulses to control an active electrophotographic process cycle, the feeding of new paper for the active cycle, and the movement of papers downstream. In other words, if the immediately available page image area is not the last used image area, as retained by last-usage latch 31, control 38 would place a "1" in stage A of shift register 27. As a result, an active cycle resulting in the utilization of page image area 18, and an updating of the last-usage latch 31 is produced.

The above-described operation of control 38 can be summarized as in Table I. The following notation is used: When the page buffer is ready, conductor 32 is represented by a "1" otherwise, a "0"; when the immediately available page image area is area 18 it is indicated as a state "0" in flip flop 39, and likewise, a "1" for area 19; a "0" state of last-usage latch 31 on conductor 36 indicates that area 18 was the last used image area, and likewise, a "1" if the last used image area was area 19. Table I reads as follows:

TABLE I

| Conductor 32 | Immediately Available Page Image Area | Conductor 36 | Control 38 Output On Conductor 28 |
|---|---|---|---|
| 0 | 0 | 0 | 0 |
| 0 | 0 | 1 | 0 |
| 0 | 1 | 0 | 0 |
| 0 | 1 | 1 | 0 |
| 1 | 0 | 0 | 0 |
| 1 | 0 | 1 | 1 |
| 1 | 1 | 0 | 1 |
| 1 | 1 | 1 | 0 |

The above-described arrangement guarantees alternate use of page image areas 18 and 19, and eliminates the problem of toner filming due to repeated accumulation of toner particles on unused page image areas during successive print cycles. This balanced photoconductor usage control system thus minimizes the high background level problem and is a better solution because it is free of other side effect problems, such as clear filming.

When the copier/printer of FIG. 1 is operating in the copy mode, a conductor 33 directly activates conductor 28, since use in the copy mode is not likely to result in successive use of one photoconductor page image area, to the exclusion of the other.

The invention described is particularly beneficial when applied to electrophotographic machines using a particular type of toner composition, or in such machines wherein an electrophotographic process is designed to operate at a slow speed so as to optimize other print/copy qualities, in order to obtain overall high quality prints and copies.

Although the balanced photoconductor usage control system 40 in FIG. 4 is shown and described for a photoconductor medium having two page image areas, the system can be extended to work equally effectively with a photoconductor medium having more than two page image areas. More specifically, the balanced photoconductor usage control system can be adopted to effect the production of the next page on any one of the unused page image areas other than the page image area which was last used. This can be accomplished by increasing the size (i.e., more bits) of both the last-usage latch 31 and flip flop 39 to accommodate representation of the resulting larger number of page image areas.

Although the balanced photoconductor usage control system 40 in FIG. 4 is shown and described in conjunction with an electrophotographic copier/printer machine, it is clear that the system can work just as effectively in an electrophotographic printer to avoid problems associated with toner-filming.

From the preceeding detailed description of Applicant's invention, it will be seen that electrophotographic copier/printer machines incorporating such a balanced usage control system have advantages heretofore not possible to achieve. In addition to the variation and modification of Applicant's disclosed apparatus which have been suggested, many other variations and modifications will be apparent to those skilled in the art, and accordingly, the scope of Applicant's invention is not to be construed to be limited to the particular embodiments shown or suggested.

I claim:

1. A balanced photoconductor usage control system for an electrophotographic copier/printer having a page buffer and an endless run of photoconductor containing thereon a plurality of page image areas, comprising:

memory means for designating a page image area as last-used in a print operation;

identification means for determining which page image area is immediately available for printing; and control means jointly responsive to a full page condition in said page buffer, said memory means and said identification means to effect skipping of an immediately available page image area when it is last-used, and to effect printing of a next page using the immediately available page when it is not last-used.

2. A balanced photoconductor usage control system for an electrophotographic copier/printer having a page buffer and an endless run of photoconductor containing thereon two page image areas, comprising:

memory means for designating a page image area as last-used in a print operation;

identification means for determining which page image area is immediately available for printing; and control means jointly responsive to a full page condition in said page buffer, said memory means and said identification means to effect skipping of an immediately available page image area when it is last-used, and to effect printing of a next page using the immediately available page when it is an alternate page.

3. A balanced photoconductor usage control system as set forth in claim 2 wherein said memory means is a latch.

4. A balanced photoconductor usage control system as set forth in claim 3 wherein said identification means includes a flip flop.

5. A dual mode electrophotographic copier/printer having a laser beam device for producing latent electrostatic images of data on a revolving endless photoconductive surface comprising:

memory means for designating an area of the surface as last-used in a laser beam printing operation;

storage means for storing data to be printed by the laser beam device;

identification means associated with said storage means for indicating the presence of data therein ready to be printed by said laser beam device;

timing means associated with said revolving photoconductive surface; and means controlled by said timing means, said identification means and said memory means to activate said laser beam device so that data from said storage means are imaged on an area of said photoconductive surface, other than that area last used in a printing operation for printing of next page.

6. A dual mode electrophotographic copier/printer having a laser beam device for producing latent electrostatic images of data on a revolving endless photoconductive surface having thereon two page image areas, comprising:

memory means for designating a page image area as last-used in a laser beam printing operation;

storage means for storing data to be printed by the laser beam device;

identification means associated with said storage means for indicating the presence of data therein ready to be printed by said laser beam device;

timing means associated with said revolving photoconductive surface; and means controlled by said timing means, said identification means and said memory means to activate said laser beam device so that data from said storage means are imaged on an alternate page image area for printing of next page.

7. A dual mode electrophotograhic copier/printer as set forth in claim 6 wherein said storage means is a page buffer.

8. A dual mode electrophotographic copier/printer as set forth in claim 7 wherein said memory means is a latch.

9. A dual mode electrophotographic copier/printer as set forth in claim 8 wherein said timing means includes a drum position transducer having its output driving a flip flop.

10. An electrophotographic printer having a laser beam device for producing latent electrostatic images of data on a revolving endless photoconductive surface comprising:

memory means for designating an area of the surface as last-used in a laser beam printing operation;

storage means for storing data to be printed by the laser beam device;

identification means associated with said storage means for indicating the presence of data therein ready to be printed by said laser beam device;

timing means associated with said revolving photoconductive surface; and means controlled by said timing means, said identification means and said memory means to activate said laser beam device so that data from said storage means are imaged on an area of said photoconductive surface, other than that area last used in a printing operation, for printing of next page.

11. An electrophotographic printer having a laser beam device for producing latent electrostatic images of data on a revolving endless photoconductive surface having thereon two page image areas, comprising:

memory means for designating a page image area as last-used in a laser beam printing operation;

storage means for storing data to be printed by the laser beam device;

identification means associated with said storage means for indicating the presence of data therein ready to be printed by said laser beam device;

timing means associated with said revolving photoconductive surface; and means controlled by said timing means, said identification means and said memory means to activate said laser beam device so that data from said storage means are imaged on an alternate page image area for printing of next page.

12. An electrophotographic printer as set forth in claim 11 wherein said storage means is a page buffer.

13. An electrophotographic printer as set forth in claim 12 wherein said storage memory means is a latch.

14. An electrophotographic printer as set forth in claim 13 wherein said timing means includes a drum position transducer having its output driving a flip flop.

15. In an electrophotographic machine having an endless run of photoconductor incorporating a plurality of page image areas, and having both a copy mode and a print mode wherein in the print mode a character generator is enabled to drive a laser printer only after a page buffer contains a full page of data to be printed, the improvement comprising:

identification means for determining which page image area is immediately available for printing;

memory means for designating a page image area as last used to produce a page; and control means jointly responsive to a presence of a full page condition in the page buffer, said identification means, and to said memory means, to effect production of a next page on an other than said last used page image area.

16. In an electrophotographic machine having an endless run of photoconductor incorporating two page image areas, and having both a copy mode and a print mode wherein in the print mode a character generator is enabled to drive a laser printer only after a page buffer contains a full page of data to be printed, the improvement comprising:

identification means for determining which page image area is immediately available for printing;

memory means for designating a page image area as last used to produce a page; and control means jointly responsive to a presence of a full page condition in the page buffer, said identification means and to said memory means, to effect production of a next page on an alternate page image area.

* * * * *